US009243526B2

(12) United States Patent
Mehring et al.

(10) Patent No.: US 9,243,526 B2
(45) Date of Patent: Jan. 26, 2016

(54) INTERNAL COMBUSTION ENGINE HAVING AN OIL CIRCUIT AND METHOD FOR OPERATING SUCH AN INTERNAL COMBUSTION ENGINE

(75) Inventors: Jan Mehring, Cologne (DE); Klemens Grieser, Langenfeld (DE); Kai Sebastian Kuhlbach, Bergisch Gladbach (DE); Bernd Steiner, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 404 days.

(21) Appl. No.: 13/457,971

(22) Filed: Apr. 27, 2012

(65) Prior Publication Data

US 2012/0291728 A1 Nov. 22, 2012

(30) Foreign Application Priority Data

May 20, 2011 (DE) ..... 10 2011 076 197

(51) Int. Cl.

| | |
|---|---|
| ***F01L 9/02*** | (2006.01) |
| ***F01M 1/16*** | (2006.01) |
| ***F01L 13/00*** | (2006.01) |
| *F01M 1/02* | (2006.01) |

(52) U.S. Cl.

CPC ..... *F01M 1/16* (2013.01); *F01L 13/0005* (2013.01); *F01M 2001/0238* (2013.01)

(58) Field of Classification Search

CPC ..... F01L 13/0005; F01L 1/2405; F01L 1/24; F01L 1/14; F01L 1/143; F01L 1/146; F01L 2001/186

USPC ..... 123/90.12, 90.15, 90.16

See application file for complete search history.

(56) References Cited

U.S. PATENT DOCUMENTS

| | | | | |
|---|---|---|---|---|
| 7,681,543 | B2 * | 3/2010 | Shin et al. | 123/90.48 |
| 2002/0115526 | A1 * | 8/2002 | Wakashiro et al. | 477/5 |
| 2002/0116112 | A1 * | 8/2002 | Wakashiro et al. | 701/110 |
| 2002/0189575 | A1 * | 12/2002 | Rayl et al. | 123/198 F |
| 2005/0055152 | A1 * | 3/2005 | Wakashiro et al. | 701/110 |
| 2010/0186694 | A1 * | 7/2010 | Albertson et al. | 123/90.16 |
| 2011/0066357 | A1 * | 3/2011 | Rollinger et al. | 701/105 |
| 2011/0165010 | A1 * | 7/2011 | Iijima | 418/269 |

FOREIGN PATENT DOCUMENTS

| | | | |
|---|---|---|---|
| DE | 102007018775 | A1 | 10/2008 |
| DE | 102007024129 | A1 | 12/2008 |
| JP | 59025021 | A | 2/1984 |
| JP | 2010203370 | A | 9/2010 |

* cited by examiner

*Primary Examiner* — Jesse Bogue
*Assistant Examiner* — Daniel Bernstein
(74) *Attorney, Agent, or Firm* — Julia Voutyras; Alleman Hall McCoy Russell & Tuttle LLP

(57) ABSTRACT

A method for operating an engine is provided. The method comprises adjusting an oil pressure in an oil circuit, the oil circuit including a pump in fluidic communication with a hydraulically adjustable cam follower and switching the hydraulically adjustable cam follower into a connected state to a disconnected in response to the oil pressure adjustment.

20 Claims, 4 Drawing Sheets

INTERNAL COMBUSTION ENGINE HAVING AN OIL CIRCUIT AND METHOD FOR OPERATING SUCH AN INTERNAL COMBUSTION ENGINE

CROSS REFERENCE TO RELATED APPLICATION

The present application claims the benefit of and priority to German Patent Application Number 102011076197.7, filed on May 20, 2011, the content of which is incorporated herein by reference for all purposes.

BACKGROUND/SUMMARY

Internal combustion engines may be used to provide motive power to a vehicle. During operation of an engine exhaust gases are removed from one or more cylinders after combustion. Subsequently fresh air and gas are flowed into the one or more cylinders for another combustion cycle.

Intake and exhaust ports may be included in the cylinder and provide fluidic communication between the intake and exhaust systems and the cylinder. Thus, the intake port provides intake air to the cylinder and the exhaust port enables exhaust gases to be expelled from the cylinder. It will be appreciated that the intake and exhaust ports may be referred to as ports.

To control combustion, lift-valves (e.g., intake valve, exhaust valve) may be used to provide an oscillatory lifting movement and in this way open and close the intake and exhaust ports. It will be appreciated that the engine may perform a four-stroke combustion cycle. Furthermore, valve actuating mechanisms are used to adjust or move the lift-valves. The valves and valve actuating mechanism may be referred to as a valve train. The valve train functions to open and close the intake and exhaust ports at desired time intervals. One of the objectives of the valve train may be to open the intake and exhaust ports quickly to reduce throttles losses in the intake and exhaust gas flows to provide efficient charging of the cylinder with intake air and completely expel exhaust gasses from the cylinder. Some engines are equipped with two or more intake and exhaust ports. Tappets may be included in the valve actuating mechanisms. In some engines, electrically controlled solenoid valves are used to connect the tappets to the oil circuit or to isolate the tappets from the oil circuit. In this way, valve operation may be enabled or inhibited via the electronically controlled solenoid valves. Specifically, an electromagnet, which when energized opens the solenoid valve, is activated by an engine control.

The Inventors have recognized several drawbacks with using electronically controlled solenoid valves to adjust the tappets. Firstly, electronically controlled solenoid valves may be expensive and therefore increase the engine's cost. The high costs of these electrically controlled and actuated valves represent an obstacle to their use in large scale production. Furthermore, the complex design of the solenoid valves may be prone to failure and/or malfunctioning. A further disadvantage lies in the complex control of the valve and in the event of solenoid valve failure or malfunction the valve may fail to open.

As such in one approach, a method for operating an engine is provided. The method comprises adjusting an oil pressure in an oil circuit, the oil circuit including a pump in fluidic communication with a hydraulically adjustable cam follower and switching the hydraulically adjustable cam follower into a connected state to a disconnected in response to the oil pressure adjustment.

In this way, the state of the hydraulically adjustable cam follower may be switched based on the oil pressure in the oil circuit. Thus, the cam follower can be passively switched via internal components in the cam follower. As a result, the cost of the engine is reduced when compared to engines that may utilize solenoid valves to control cam followers. Moreover, the likelihood of cam follower malfunctioning may be decreased when the cam followers are passively switched.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

The Invention is described in more detail below with reference to FIGS. 1-4.

DETAILED DESCRIPTION

Figure 1:
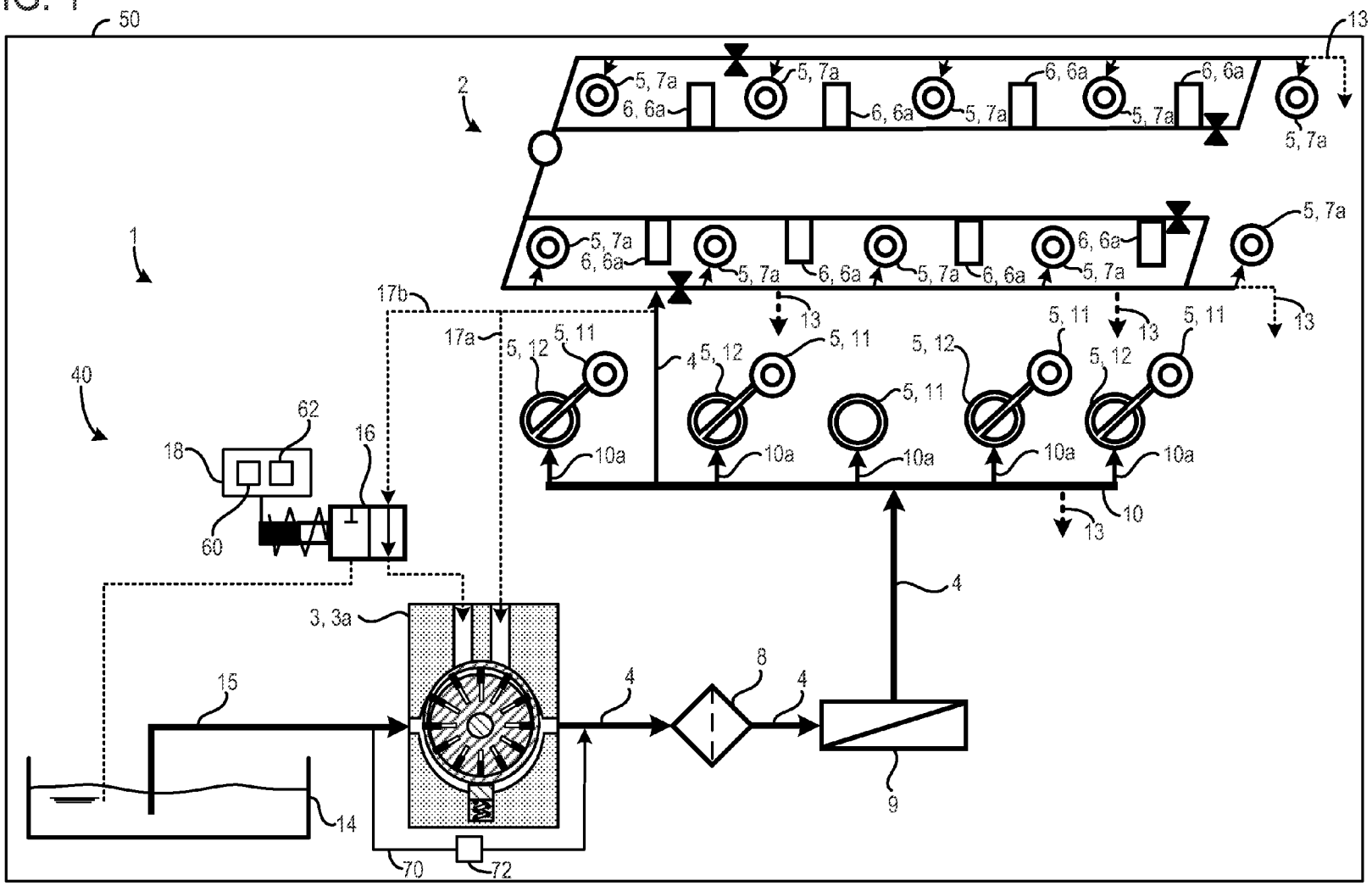
FIG. 1 schematically shows the oil circuit of a first embodiment of the internal combustion engine with parts of the valve train.

FIG. 1 schematically show an embodiments of an oil circuit 1 included in an internal combustion engine 50. A valve train 2 and it various components are also included in the internal combustion engine. In the context of the present invention the term internal combustion engine encompasses not only spark-ignition engines and diesel engines but also hybrid internal combustion engines.

A pump 3 is provided in the oil circuit 1. The pump 3 provides head pressure to the oil in the oil circuit 1, when desired. Thus, the pump 3 enables oil to be circulated in the oil circuit.

In some examples, the pump may be vane pump, the eccentricity of which is adjustable. Like a piston pump, a vane pump may functions on the displacement principle, but in contrast to the former it does not function in an oscillatory and thereby intermittent manner, but rotationally and thereby continuously, which may be advantageous. Rotating in a hollow cylinder serving as stator may be another cylinder serving as rotor, the axis of rotation of the rotor being arranged eccentrically in relation to the stator. The pump 3 may also include multiple radially arranged slides supported so that they are able to traverse in the rotor. The slides may divide the space between the stator and the rotor into multiple chambers. The delivery of the pump can be varied by adjusting the eccentricity of the rotor, an increased delivery leading to an increased oil pressure at the pump outlet. The eccentricity can be adjusted via an engine control 18 using an electrically controllable valve, the valve opening or closing an oil pressure line to the vane pump. The engine control 18 may include memory 60 executable by a processor 62. The area exposed to the oil or the oil pressure can be increased or reduced through the actuation of the valve, so that the spring force of a return spring acts in opposition to a greater or lesser force resulting from the oil pressure and varies the eccentricity. However, in other embodiments the pump 3 may be a gear pump or a displacement pump.

A suction line 15 is also included in the oil circuit 1. The suction line 15 feeds oil to the pump 3. Thus, the suction line 15 is in fluidic communication with the pump 3. The suction line 15 also opens into an oil sump 14. Thus, the suction line includes an inlet positioned in the oil sump 14. The oil sump 14 collects and stores engine oil. It will be appreciated that the oil sump 14, suction line 15, and/or pump 3 are included in the oil circuit 1. Furthermore, the oil sump 14 may serve as a heat exchanger for reducing the oil temperature in the engine 50, in some examples. Thus, the oil in the oil sump 14 may be cooled by thermal conduction and convection by an air flow passing the outside of the sump.

For limiting the oil pressure in the oil circuit, a bypass line 70, (e.g., a short-circuit line) may be provided, which branches off from a supply line 4 downstream of the pump 3, immediately after the pump, and opens into the suction line 15 upstream of the pump. A pressure relief valve 72 may be positioned in the bypass line 70. The pressure relief valve 72 may open (e.g., enable oil to flow therethrough) automatically when the oil pressure in the bypass line exceeds a predetermined oil pressure.

The pump 3 delivers the oil to the lubricant receiving components 5 provided in the oil circuit 1 via a supply line 4. It will be appreciated that the pump 3 and the suction line 15 may be designed (e.g., sized) to provide a desired range of oil flowrates to downstream components in the oil circuit 1.

As shown, oil first flows through a filter 8, arranged downstream of the pump 3, and a coolant-operated oil cooler 9, which is arranged downstream of the filter 8 and which may be deactivated during the warm-up phase. Thus, the oil cooler 9 and the filter 8 are arranged upstream of the valve train 2. A warm-up phase is a time interval when the engine 50 is below a predetermined temperature. However, other arrangements of the filter and coolant-operated oil cooler have been contemplated.

The oil cooler 9 may reduce the likelihood overheating of the oil, which can adversely affect the characteristics of the oil, in particular the lubricity, and may cause more rapid ageing of the oil. During the warm-up phase the oil cooler may be bridged by a bypass line or conversely used as a device for heating the oil. The filter 8 may retain particles, especially solid particles resulting from the abrasion, in order to protect downstream components in the oil circuit, particularly the consumers, from damage.

The oil circuit may be controlled or regulated with regard to the oil pressure downstream of the filter and/or oil cooler. The reason for this control strategy is that the pressure at the pump outlet, i.e. upstream of the filter and/or the oil cooler, may not always permit conclusions as to the oil pressure downstream of these components. The latter, however, may be the oil pressure for the valve train. If the filter is heavily charged, i.e. heavily fouled, this pressure may be too low, although a high, to all appearances adequate oil pressure prevails at the pump outlet.

Figure 2:
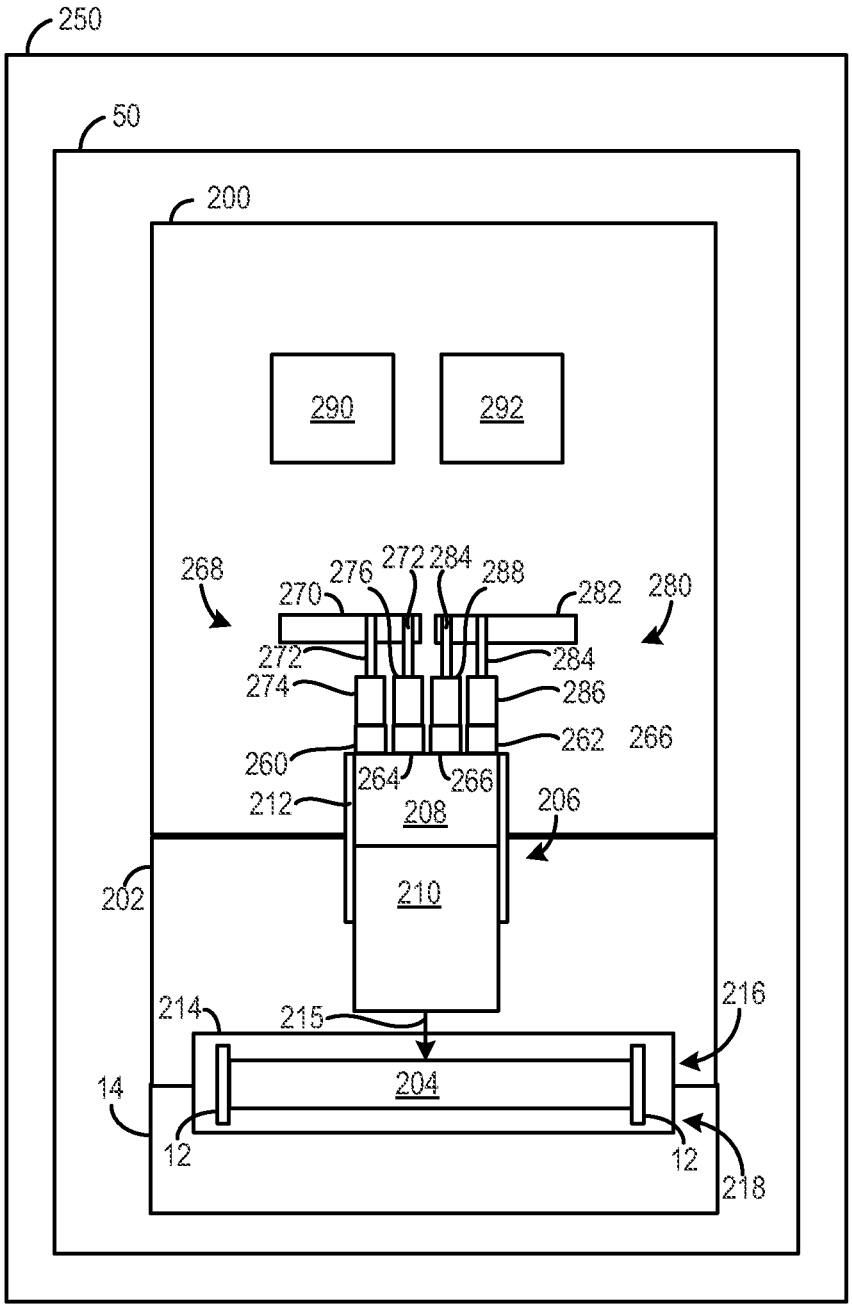
FIG. 2 shows another schematic depiction of the internal combustion engine shown in FIG. 1.

In some examples, the supply line 4 may traverse the cylinder block 202, shown in FIG. 2, before it enters the cylinder head 200, shown in FIG. 2. However, in other embodiments, the supply line 4 may traverse the cylinder head 200 and then the cylinder block 202. It will be appreciated that the oil may be heated as it passes through the cylinder block 202 and the cylinder head 200.

Downstream, the supply line 4 opens into the main oil gallery 10, from which ducts 10*a* lead to the main bearings 12 of the crankshaft and the big end bearings 11, in order to supply the bearings with oil.

From the main oil gallery 10, which may be arranged in a cylinder block 202 shown in FIG. 2, the supply line 4 leads to a cylinder head 200 shown in FIG. 2 and other lubricant receiving components 5 (e.g., an intake-side camshaft bearings 7*a*,an exhaust-side camshaft bearings 7*b*,and cam followers 6 of a valve train 2).

Specifically, at least two bearings must be provided for each camshaft. The bearings may have a two-part design and may each comprise a bearing saddle and a bearing cap which can be connected to the bearing saddle. Here the bearing cap and the bearing saddle may be designed as separate components or they may be integrally formed with the cylinder head or a cover. Bearing shells may be arranged as intermediate elements between the camshaft and the bearings. In an assembled state each bearing saddle may connected to the corresponding bearing cap. A bearing saddle and a bearing cap in each case may form a bore for mounting the camshaft, where desired in conjunction with bearing shells as intermediate elements. The bores may be supplied with engine oil via the oil circuit 1, so that as the camshaft rotates a load-bearing lubricating film—similar to a slide bearing—is formed, in some cases between the inside face of each bore and the camshaft.

It will be appreciated, that the intake-side camshaft bearings 7*a* may enable rotation of an intake camshaft 270, shown in FIG. 2. Likewise, the exhaust-side camshaft 7*b* bearings may enable rotation of an exhaust camshaft 282, shown in FIG. 2. The intake camshaft may be configured to actuate an intake valve and the exhaust camshaft may be configured to actuate an exhaust valve. When overhead camshafts are utilized the bearings may be in the cylinder head.

Cam followers 6 may be connected to the oil circuit 1. Specifically, the cam followers 6 may be hydraulically adjustable (e.g., hydraulically controllable, hydraulically connectible) tappets 6*a*,in some embodiments. The hydraulically adjustable tappets 6*a* may be connected and disconnected by varying the oil pressure to which the hydraulically adjustable tappets 6*a* are subjected. The hydraulically adjustable tappets 6*a* are activated or deactivated by increasing or reducing the oil pressure. In this way, completely isolating the followers (e.g., tappets) from the oil circuit may be avoided, if desired. As a result, electrically controlled solenoid valves may not be used in the oil circuit, if desired. In this way, the cost of the oil circuit 1 may be reduced due to the high cost of the solenoid valves.

At least one of the hydraulically adjustable tappets may comprises two separate but inter-connectible components, which are rigidly connected together when the tappet is in the connected state, and moveable relative to one another when it is in the disconnected state. The connection can be made using a pin, bolt or control piston, for example, which is subjected to the oil pressure of the oil circuit and which, when a predefined oil pressure is exceeded, is traversed in opposition to the return force of a spring, in such a way that it connects, i.e. locks the two separate components of the tappet together.

In order to be able to vary the oil pressure in the supply line 4 of the oil circuit 1, a vane pump 3*a*,in which a cylinder serving as rotor rotates in a hollow cylinder serving as stator, is used for delivering the oil. The eccentricity of the axis of rotation of the rotor is variable, so that the delivery of the pump 3, 3*a* is adjustable. An increased delivery leads to an increased oil pressure at the pump outlet. Thus, the pump 3 may be a variable pump such that the oil pressure delivered downstream of the pump and specifically at the outlet of the pump is controllable.

The eccentricity may be adjusted using an electrically controllable pump valve 16 (e.g., solenoid valve), which in addition to a permanently open pressure line 17*a* opens or closes a further oil pressure line 17*b* to the vane pump 3*a* and which is actuated by the engine control 18. The area exposed to the oil or the oil pressure is increased or reduced through actuation of the valve 16, so that the spring force acts in opposition to a greater or lesser force resulting from the oil pressure and varies the eccentricity. The pump valve 16 may be a solenoid valve in electronic communication with the engine control 18.

Return lines 13 are provided, which may return the engine oil into the oil sump 14 under gravity. For supplying the main bearings 12 with oil, the supply line 4 opens into a main oil gallery, from which ducts lead to at least the two main bearings, which supply the bearings with oil.

The main oil gallery 10 may include a main supply duct, which is aligned along the longitudinal axis of the crankshaft 204, shown in FIG. 2, may be provided in order to form the main oil gallery 10. The main supply duct may be arranged above or below the crankshaft 204, shown in FIG. 2, in the crankcase 214 or it may also be integrated into the crankshaft.

In order to supply the valve train 2 with oil, the supply line 4 may lead from the main oil gallery 10 into the cylinder head 200, shown in FIG. 2. Alternatively, a supply line may be provided, which leads from the pump 3 directly into the cylinder head 200, supplies the camshaft mounting with engine oil and then leads downstream to the main oil gallery 10. The camshaft mounting may be supplied with oil similar to the crankshaft.

The oil circuit 1 may also serve to supply further consumers with oil, for example the crankshaft 204, shown in FIG. 2. Connecting rod bearings or balancer shaft(s) may also be supplied with oil. Splash oil cooling may also be provided to the pistons via the oil circuit 1. Splash oil cooling may involve spraying oil on the pistons. A hydraulically actuated camshaft adjuster or other valve train components, for hydraulic valve clearance adjustment, for example, may also be supplied with oil via the oil circuit and are discussed in greater detail herein.

FIG. 2 shows another schematic depiction of the internal combustion engine 50, shown in FIG. 1. It will be appreciated that the components shown in FIGS. 1 and 2 may each be included in the engine 50. The engine 50 may be included in a vehicle 250.

The engine 50 includes a cylinder head 200. It will be appreciated that in other embodiments the engine 50 may include two or more cylinder heads. The cylinder head 200 may be connected to a cylinder block 202. A portion of the cylinder block 202 may accommodate a crankshaft 204 and the main bearings 12. As previously discussed, the main oil gallery 10, shown in FIG. 1, may supply the main bearings 12 with oil and the main oil gallery may be in fluidic communication with the supply line 4.

The cylinder head 200 and the cylinder block 202 may form a cylinder 206. The cylinder 206 may be referred to as a combustion chamber. It will be appreciated that in other embodiments a plurality of cylinders may be formed by the cylinder head 200 and the cylinder block 202.

Although a single cylinder is depicted in the engine 50, shown in FIG. 2, it will be appreciated that the engine 50 may include additional cylinders. For example, the engine may include four cylinders, five cylinders, six cylinders, etc. Moreover, it will be appreciated that the engine 50 may be operated to perform a 4-stroke combustion cycle in each of the cylinders.

The cylinder block 202 may include a cylinder bore 208 for mounting (e.g., receiving) a piston 210 and a cylinder liner 212. However, in other embodiments a portion of the cylinder bore 208 and/or cylinder liner 212 may be included in the cylinder head 200.

The piston 210 may be guided so that it is axially moveable in the cylinder liner 212 and together with the cylinder liner and the cylinder head 200 defines the combustion chamber of the cylinder 206.

The head of the piston 210 may form a part of the combustion chamber inside wall and together with the piston rings seals off the combustion chamber from the cylinder block 202 and a crankcase 214, so that substantially no combustion gases and no combustion air get into the crankcase and no oil gets into the combustion chamber. The crankcase 214 may enclose the crankshaft 204.

The piston 210 may serves to transmit the gas forces generated by the combustion to the crankshaft 204. For this purpose the piston 210 may be pivotally connected by a piston pin to a connecting rod, which is in turn rotatably supported on the crankshaft 204. The aforementioned linkage is denoted via arrow 215.

The crankshaft 204 supported in the crankcase 214 absorbs the connecting rod forces, which are made up of gas forces resulting from the fuel combustion in the combustion chamber, and the inertial forces resulting from the irregular movement of the engine parts. In so doing the oscillatory lifting movement of the piston 210 is translated into a rotational movement of the crankshaft 204. The crankshaft 204 here transmits the torque to the drivetrain. A proportion of the energy transmitted to the crankshaft is preferably used to drive auxiliary units, such as the oil pump 3 and the alternator, or serves for driving at least the one camshaft and thereby for actuating the valve train 2.

For mounting and supporting the crankshaft 204 the main bearings 12 are provided. In some examples, the main bearings 12 may have a two-part design and each comprise a bearing saddle and a bearing cap that can be connected to the bearing saddle. The crankshaft 204 may be supported in the area of the crankshaft journals, which may be arranged at an interval from one another along the crankshaft axis and are generally embodied as enlarged shaft shoulders.

In some examples, the cylinder block 202 may include an upper crankcase portion 216. The upper crankcase portion 216 may be spaced away from the cylinder head 200. A portion of the oil sump 14 may serve as a lower crankcase portion 218.

The engine 50 further includes a deactivatable intake valve 260 and a deactivatable exhaust valve 262. The deactivatable valves (260 and 262) are configured to be deactivated when desired. Additionally, the engine 50 may further include a second intake valve 264 and a second exhaust valve 266. In some examples, the second intake valve 264 and the second exhaust valve 266 may be deactivatable valves. However, in other examples, the valves may not be deactivatable. The intake valves (260 and 264) may be in fluidic communication with an intake manifold 290. Likewise, the exhaust valves (262 and 266) may be in fluidic communication with an exhaust manifold 292.

The intake and exhaust valves (260, 262, 264, and 266) may be moveable, that is to say displaceable, along their longitudinal axis between a valve closing position and a valve opening position, in order to open or close a port of a cylinder.

In some examples, the valves may include springs for biasing the valves towards the valve closing position. The aforementioned valves (260, 262, 264, and 266) may be included in the valve train 2.

It will be appreciated that at least a portion of the aforementioned valves may be connectible. That is to say that they may be selectively activated and deactivated depending on the operating conditions in the engine 50. When small quantities of fresh air are fed to the cylinder 206 of the internal combustion engine 50 in the course of the charge cycle, for example at low engine speeds and/or under low load, it may be desirable to disconnect, i.e. to deactivate at least the two of the valves, in order provide a desired intake and exhaust gas flowrate.

Specifically, it may also be desirable to deactivate exhaust valves, for example in the case of a supercharged internal combustion engine having two exhaust-gas turbochargers arranged in parallel, in which the cylinders comprise two exhaust ports, and the exhaust lines of the first exhaust ports of the cylinders are united into a first exhaust manifold and the exhaust lines of the second exhaust ports of the cylinders may be united into a second exhaust manifold before these manifolds are each connected to the turbine of an exhaust-gas turbocharger.

The turbine of an exhaust-gas turbocharger may be designed as a connectible turbine, by designing the exhaust ports of the associated exhaust manifold as connectible exhaust ports. In some embodiments the connectible exhaust valves may be opened in the course of the charge cycle when the flowrate of the exhaust gas exceeds a predetermined value, thereby activating the connectible turbine through the admission of exhaust gas. In this way, the operating performance of the internal combustion engine may be improved, particularly with small quantities of exhaust gas, i.e. at low loads and low engine speeds. Disconnecting a valve may serves to reduce the friction or friction loss of the valve train, thereby reducing the fuel consumption. A valve may be designed as a connectible valve by using a hydraulically adjustable tappet as cam follower, which can be connected to the oil circuit, the tappet being connected when it is subjected to the oil pressure, or disconnected when it is isolated from the oil circuit. Such a configuration is described in greater detail herein.

The valve train 2 further includes components for actuating the valves such as an intake valve actuating assembly 268 including an intake camshaft 270 having intake cams 272 for actuating both the deactivatable intake valve 260 and the second intake valve 264. Thus, the intake cams 272 are arranged on the intake camshaft 270. The intake valve actuating assembly 268 further includes a first intake cam follower 274 and a second intake cam follower 276. The first and second intake cam followers (274 and 276) may be included in the plurality of cam followers (6 and 6*a*), shown in FIG. 1. The first intake cam follower 274 is selectively deactivatable and hydraulically controlled via oil in the oil circuit 1. Therfore, the intake cam followers (274 and 276) are arranged in the power flow between the intake cams 272 and the intake valves (260 and 264).

Specifically, the first intake cam follower 274 may have a connected state in which the first intake cam follower recieves rotation energy from one of the intake cams 272 and transfers the energy to the deactivatable intake valve 260 to perform an oscillatory lifting movement. The first intake cam follower 274 may also have a disconnected state in which the transfer of energy from one of the intake cams 272 to the deactivatable intake valve 260 is inhibited. Thus, the first cam follower 274 may be selectively deactivatable.

The valve train 2 further includes an exhaust valve actuating assembly 280 including an exhaust camshaft 282 having exhaust cams 284 for actuating both the deactivatable exhaust valve 262 and the second exhaust valve 266. Thus, the exhaust cams 284 are arranged on the exhaust camshaft 282. The exhaust valve actuating assembly 280 also includes a first exhaust cam follower 286 and a second exhaust cam follower 288. The first and second exhaust cam followers (286 and 288) may be included in the plurality of cam followers (6, 6*a*), shown in FIG. 1. The first exhaust cam follower 286 is selectively deactivatable and hydraulically controlled via oil in the oil circuit 1.

In some examples, chain drives may be used to couple the intake camshaft 270 and the exhaust camshaft 282 to the crankshaft 204. However, other coupling techniques have been contemplated. Specifically, the camshafts may rotate at half of the crankshaft speed in some embodiments. Additionally, the camshafts (270 and 282) may be bottom-mounted camshafts in some embodiments. Bottom-mounted camshafts may be used to actuate upright valves with the aid of push rods and levers, for example rocker arms or valve levers. Upright valves are opened by displacing them upwards, whereas overhead valves are opened by a downward movement. In such an embodiment tappets may be used as intermediate element, which may be in engagement with the cam of the camshaft at least during an opening and closing sequence. However, in other embodiments the camshafts (270 and 282) may be overhead camshafts. The overhead camshafts may use rocker arms or valve levers to actuate valves. Specifically, the overhead camshafts may be used to actuate overhead valves. A valve train with overhead camshaft may include a rocker arm, a valve lever or a tappet in the valve train components. The rocker arm may rotate about a fixed center of rotation and when deflected by the cam displaces the valve towards the valve opening position against the biasing force of a valve spring. In the case of a valve lever, which is pivoted about a centrally arranged center of rotation, the cam may acts on the one end of the valve lever, the valve being arranged at the opposite end of the lever. One advantage to the use of overhead camshafts is that the absence of the push rod, in particular, serves to reduce the moving mass of the valve train and the valve train is more rigid, that is to say less flexible.

At least a portion of the intake and exhaust cam followers may be tappets, in some embodiments. The tappets each may be attached to the end of a lift-valve remote from the combustion chamber, so that the tappets participates in the oscillatory lifting movement of the valve when the cam in the area of the cam lobe is in engagement with the tappet and deflects the latter. When the cam is in engagement with the tappet, the cam with the cam generated surface may slide along a line of contact on the surface of the tappet. In order to facilitate sliding and to reduce the wear of both components, the contact zone between cam and tappet may be supplied with lubricating oil. A load-bearing lubricating film may form between the cam and the tappet due to the relative movement of the two components. The wearing of the cam and the tappet may be disadvantageous not only in terms of the service life of these components, but also in terms of the functional efficiency of the valve train. Material abrasion on the cam and/or the tappet has an influence on the valve clearance and effects on the valve lift and the port timing, that is to say the crank angles at which the valve opens and closes.

The first exhaust cam follower 286 may have a connected state in which the first exhaust cam follower recieves rotation energy from one of the exhaust cams 284 and transfers the energy to the exhaust valve 262 to perform an oscillatory lifting movement. The first exhaust cam follower 286 may also have a disconnected state in which the transfer of energy from one of the exhaust cams 284 to the exhaust valve 262 is inhibited.

The oil pressure in the oil circuit 1 may trigger adjustment of the states of both the first intake cam follower 274 and the first exhaust cam follower 286. Method for operating the intake and exhaust cam followers (274 and 28, respectively) are discussed in greater detail herein with regard to FIGS. 3 and 4.

Figure 3:
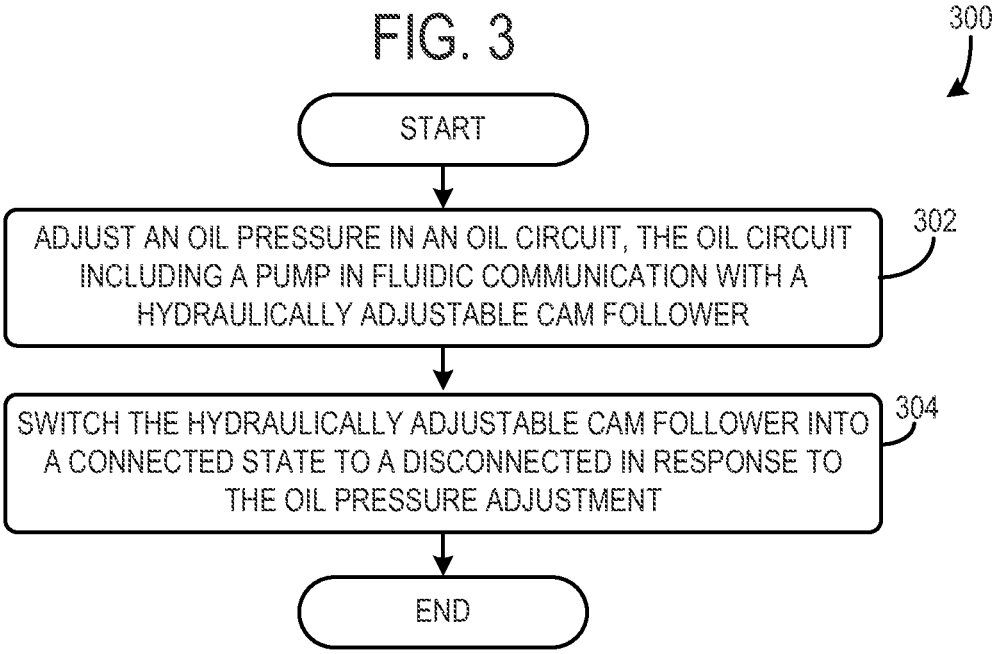
FIG. 3 shows a method for operation of an internal combustion engine.

FIG. 3 shows a method 300 for operation of an engine. It will be appreciated that the method 300 may be used to operate the engine 50 described above with regard to FIGS. 1-2 or may be used to operate another suitable engine.

At 302 the method includes adjusting an oil pressure in an oil circuit, the oil circuit including a pump in fluidic communication with a hydraulically adjustable cam follower and at 304 switching the hydraulically adjustable cam follower into a connected state to a disconnected in response to the oil pressure adjustment. It will be appreciated that adjusting the oil pressure may include increasing the oil pressure. Furthermore, the oil pressure in the oil circuit is increased in response to an increase in at least one of engine load and engine speed. Additionally, the oil pressure in the oil circuit may be increased by increasing the output of the pump, as discussed above with regard to FIG. 1. On the other hand, adjusting the oil pressure may include decreasing the oil pressure. However, in other embodiments adjusting the oil pressure in the oil circuit may include decreasing the oil pressure.

In some examples, the oil pressure in the oil circuit may be increased when a quantity of air provided to the cylinder exceeds a predefined quantity of air. In the case of a non-supercharged internal combustion engine the quantity of air and the quantity of exhaust gas may correspond approximately to the speed and/or the load of the internal combustion engine, irrespective of the load control used in each individual case. In the case of a conventional spark-ignition engine with quantity control, the quantity of air may increase with increasing load even at a constant engine speed, whereas the quantity of fresh air in conventional diesel engines with quality control may vary as a function of the engine speed, because with a variation in the load and a constant engine speed it is the composition of the mixture that varies, not the mixture quantity. The internal combustion engine may use quality control, in which the load may be controlled via the quantity of air, if the load of the internal combustion engine exceeds a predefined load, the quantity of air may exceed a relevant, i.e. predefined quantity of fresh air even at constant engine speed, since the quantity of fresh air correlates with the load, the quantity of fresh air increasing with an increasing load and diminishing with a diminishing load.

On the other hand, if the engine in which the load is controlled via the composition of the mixture, and the quantity of air may vary with the engine speed, i.e. it is proportional to the engine speed, if the engine speed of the internal combustion engine exceeds a predefined engine speed the quantity of air exceeds a predefined quantity of air irrespective of the load.

Additionally, if the internal combustion engine is moreover a supercharged internal combustion engine, additional account must be taken of the boost pressure on the intake side, which may vary with the load and/or the engine speed and which has an influence on the quantity of air. The correlations outlined above with regard to the quantity of air and the load and/or the engine speed may then only apply conditionally. For this reason, an altogether general account may be taken of the quantity of air and not of the load or engine speed.

Nevertheless, variants of the method in which the oil pressure in the oil circuit is increased with increasing load and/or increasing engine speed may be implemented. Variants of the method in which the oil pressure in the oil circuit is increased as soon as the load exceeds a predefined load and/or the engine speed exceeds a predefined engine speed may also be implemented.

In some examples, the oil pressure in the oil circuit may be increased when the load exceeds a predefined load and/or the engine speed exceeds a predefined engine speed and is greater than this predefined load and/or engine speed for a predefined period of time $\Delta t_1$. The introduction of an additional condition for the increase in the oil pressure is intended to reduce frequent switching, in particular a switching of the cam follower, when the load and/or engine speed exceeds the predefined value only briefly and then falls again, or fluctuates about the predefined value, without the excess justifying or requiring a switching of the connectible cam follower.

If the load and/or engine speed again exceeds a predefined load and/or engine speed, the connectible cam follower and the connectible valve associated therewith are again switched. For the reasons already stated, variants of the method in which the connectible cam follower is switched as soon as the load and/or engine speed fall below a predefined load and/or engine speed, and is less than this predefined value for a predefined period of time $\Delta t_2$, may also be implemented.

Figure 4:
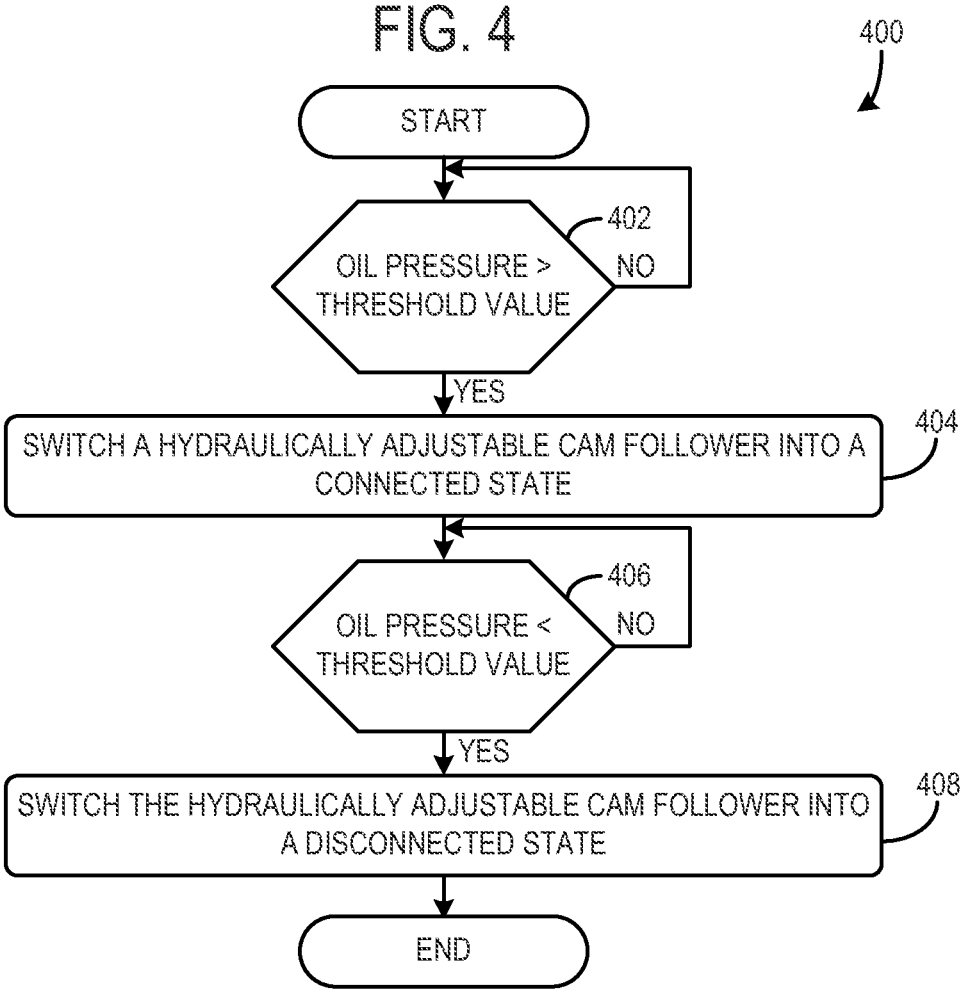
FIG. 4 shows another method for operation of an internal combustion engine.

FIG. 4 shows a method 400 for operation of an engine. It will be appreciated that the method 400 may be used to operate the engine 50 described above with regard to FIGS. 1-2 or may be used to operate another suitable engine.

At 402 the method includes determining if the oil pressure in an oil circuit is above a predetermined threshold value. If it is determined that the oil pressure is not above the predetermined threshold value (NO at 402) the method returns to 402. However, if it is determined that the oil pressure is above the predetermined threshold value (YES at 402) the method includes at 404 switching a hydraulically adjustable cam follower into a connected state. The connected cam follower may produce a lifting movement of the associated valve as the camshaft rotates. However, in other embodiments the cam follower may be switched to a disconnected state at 404. The disconnected cam follower may prevent a lifting movement of the associated valve as the camshaft rotates. The two embodiments described above comprise two possible procedures in the control and actuation of the connectible cam follower by means of oil pressure, namely either activating or deactivating the connectible cam follower when a predefined oil pressure is exceeded. The two embodiments may have different cam follower designs, namely a cam follower, which disconnects with increasing oil pressure in the first case, and a cam follower which connects with increasing oil pressure in the second case.

At 406 the method includes determining if the oil pressure in the oil circuit is below the predetermined threshold value. If is determined that the oil pressure in the oil circuit is not below the predetermined threshold value (NO at 406) the method returns to 406. However, if it is determined that the oil pressure in the oil circuit is below the predetermined threshold value (YES at 406) the method includes at 408 switching the hydraulically adjustable cam follower into a disconnected state. However, in other embodiments the cam follower may be switched to a connected state at 408.

In some example a plurality of the cam follower may be hydraulically adjustable cam followers. In such an example, each of the cam followers may be designed to be adjusted at different oil pressures. That is to say the various cam followers may switch at different oil pressures. If a cylinder of the internal combustion engine has three exhaust ports, for example, it is possible, starting from one active port, for a further exhaust port and then the third exhaust port to be connected, that is to say activated, as the oil pressure rises. It is also possible for the connectible cam followers of different cylinders to be designed to be actuated at different oil pressures.

Pressure in the oil circuit may be varied as a function of the load and the engine speed. In some examples, a higher oil pressure correlates to higher loads and engine speeds and a lower oil pressure correlates low loads and low engine speeds. The hydraulically adjustable cam follower may be designed accordingly. Such a variation in the oil pressure may be used to adjust the switching state of the cam follower, which may correspond to the variation of the load and/or the engine speed, i.e. which is suited to the adjusted load and/or engine speed.

The invention claimed is:

1. An internal combustion engine comprising:

a cylinder including an intake port and an exhaust port;

a valve train comprising a deactivatable intake valve positioned in the intake port, a deactivatable exhaust valve positioned in the exhaust port, an intake valve actuating assembly comprising an intake camshaft having an intake cam and a hydraulically adjustable intake cam follower positioned between the intake valve and the intake cam, and an exhaust valve actuating assembly comprising an exhaust camshaft having an exhaust cam and a hydraulically adjustable exhaust cam follower positioned between the exhaust cam and the exhaust valve; and an oil circuit including a variable pump and an electrically controllable pump valve coupled to an inlet of the variable pump, the variable pump providing an output of pressurized oil to a supply line of the oil circuit, a pressure of the oil output by the pump to the supply line being adjustable via the electrically controllable pump valve, the intake cam follower and exhaust cam follower in fluidic communication with an outlet of the variable pump via the supply line, wherein the intake cam follower is connected with the deactivatable intake valve and the exhaust cam follower is connected with the deactivatable exhaust valve when the pressure of the oil in the supply line exceeds a predetermined threshold, and wherein the intake cam follower is disconnected from the deactivatable intake valve and the exhaust cam follower is disconnected from the deactivatable exhaust valve when the pressure of oil in the supply line is below the predetermined threshold.

2. The internal combustion engine of claim 1, wherein when the intake cam follower is connected with the intake valve, it is in a connected state receiving rotation energy from the intake cam and transferring the energy to the intake valve to perform an oscillatory lifting movement, wherein when the intake cam follower is disconnected from the intake valve, it is in a disconnected state inhibiting the transfer of energy from the intake cam to the intake valve, wherein when the exhaust cam follower is connected with the exhaust valve, it is in a connected state receiving rotation energy from the exhaust cam and transferring the energy to the exhaust valve to perform an oscillatory lifting movement, and wherein when the exhaust cam follower is disconnected from the exhaust valve, it is in a disconnected state inhibiting the transfer of energy from the exhaust cam to the exhaust valve.

3. The internal combustion engine of claim 1, where the cylinder further comprises a second intake port and a second exhaust port.

4. The internal combustion engine of claim 1, where the intake port is in fluidic communication with an intake manifold and the exhaust port is in fluidic communication with an exhaust manifold.

5. The internal combustion engine of claim 1, where the intake and exhaust cam followers are hydraulically adjustable tappets.

6. The internal combustion engine of claim 5, where the hydraulically adjustable tappets each comprise two separate but inter-connectible components, which are connected together when the tappet is in a connected state, and moveable relative to one another when it is in a disconnected state.

7. The internal combustion engine of claim 1, where the variable pump is a vane pump, the eccentricity of which is adjustable.

8. The internal combustion engine of claim 7, where the eccentricity of the vane pump is adjustable via the electrically controllable pump valve, the electrically controllable pump valve in electronic communication with an engine control.

9. The internal combustion engine of claim 1, further comprising at least one of a filter and an oil cooler positioned in the supply line downstream of the variable pump.

10. The internal combustion engine of claim 9, where the filter and the oil cooler are arranged upstream of a valve train.

11. The internal combustion engine of claim 1, further comprising a cylinder head connected to a cylinder block, the cylinder block at least partially enclosing a crankshaft and two main bearings coupled to the crankshaft, where the supply line opens into a main oil gallery in fluidic communication with the two main bearings.

12. The internal combustion engine of claim 11, where the cylinder block includes an upper portion of a crankcase and is connected to an oil sump, the oil sump spaced away from the cylinder head and collecting and storing engine oil, the oil sump including a lower portion of the crankcase, the oil circuit further comprising a suction line positioned in the oil sump and in fluidic communication with the pump.

13. The internal combustion engine of claim 1, where the pump is a displacement pump.

14. A method for operating an engine comprising:

adjusting an oil pressure at an outlet of a variable pump in an oil circuit through adjustment of an electrically controllable pump valve coupled to an inlet pressure line of the variable pump, the oil circuit including a hydraulically adjustable cam follower in fluidic communication with the outlet of the variable pump via a supply line, wherein the hydraulically adjustable cam follower is in a connected state when an oil pressure at the outlet of the variable pump exceeds a predetermined threshold and wherein the hydraulically adjustable cam follower is in a disconnected state when the oil pressure at the outlet of the variable pump is below the predetermined threshold.

15. The method of claim 14, where adjusting the oil pressure includes increasing the oil pressure.

16. The method of claim 15, where the oil pressure in the oil circuit is increased in response to an increase in at least one of engine load and engine speed.

17. The method of claim 14, where adjusting the oil pressure includes decreasing the oil pressure.

18. The method of claim 14, where the oil pressure in the oil circuit is increased by increasing an output of the pump.

19. A method for operating an engine comprising:

switching a hydraulically adjustable cam follower into a connected state by adjusting an electrically controllable pump valve coupled to an inlet pressure line of a variable pump in an oil circuit to increase an oil pressure in the oil circuit at an outlet of the variable pump above a predetermined threshold value, the hydraulically adjustable cam follower in fluidic communication with the outlet of the variable pump; and switching the hydraulically adjustable cam follower into a disconnected state by adjusting the electrically controllable pump valve to decrease the oil pressure in the oil circuit below the predetermined threshold value.

20. The internal combustion engine of claim 1, wherein the supply line opens into a main oil gallery of the oil circuit, wherein the inlet of the variable pump is a first inlet, wherein the variable pump further comprises a second inlet, and wherein the oil circuit further comprises a first pressure line, the first pressure line coupling the main oil gallery with either the first inlet or an oil sump depending on a state of the electrically controllable pump valve, and a second, permanently open pressure line coupling the main oil gallery to the second inlet of the variable pump.

* * * * *